United States Patent [19]

Mizuno et al.

[11] 4,356,710

[45] Nov. 2, 1982

[54] INTERLOCK FABRIC WITH LINING

[75] Inventors: Toshio Mizuno, Nishinomiya; Shiro Kibata, Iida, both of Japan

[73] Assignee: Mizuno Corporation, Osaka, Japan

[21] Appl. No.: 129,212

[22] Filed: Mar. 11, 1980

[30] Foreign Application Priority Data

Mar. 12, 1979 [JP] Japan ..... 54-29228

[51] Int. Cl.[3] ..... D04B 7/04; D04B 7/16

[52] U.S. Cl. ..... 66/196; 66/202

[58] Field of Search ..... 66/196, 198, 202

[56] References Cited

U.S. PATENT DOCUMENTS

| | | | |
|---|---|---|---|
| 853,667 | 5/1907 | Williams | 66/196 |
| 872,163 | 11/1907 | Williams | 66/196 |
| 2,879,654 | 3/1959 | Evans | 66/196 X |
| 2,921,456 | 1/1960 | Evans | 66/196 X |
| 3,264,846 | 8/1966 | Pfrommer | 66/196 |
| 4,267,710 | 5/1981 | Imamichi | 66/196 |

FOREIGN PATENT DOCUMENTS

| | | | |
|---|---|---|---|
| 625950 | 4/1963 | Belgium | 66/196 |
| 391944 | 9/1965 | Switzerland | 66/196 |

*Primary Examiner*—Ronald Feldbaum
*Attorney, Agent, or Firm*—Fleit & Jacobson

[57] ABSTRACT

An interlock fabric with a lining wherein, for the front fabric, plain stitches are formed using 100% synthetic fiber yarns A, B, D, E, G, H, J, K, M, N, P, Q, S, T, V and W, and for the back fabric, use is made of yarns of a natural fiber having excellent sweat-absorption or blended yarns of the natural fiber with other fibers C, F, I, L, O, R, U and X whereby the under yarns C, F, I and L form purls at the back vertical rows $D_1$, $D_3$ and at the same time, are seamed to the knits at the front vertical row $C_2$, while the under yarns O, R, U and X form purls at the back vertical rows $D_1$, $D_3$ and at the same time, are knit-seamed by a tuck stitch at the front vertical row $C_4$, so that the front fabric has a flat surface due to the plain stitch and the back fabric has honeycomb-like gaps a due to the tuck stitch .

6 Claims, 3 Drawing Figures

INTERLOCK FABRIC WITH LINING

DETAILED DESCRIPTION OF THE INVENTION

This invention relates to an interlock fabric equipped with a lining having honeycomb-like gaps and with functional characteristics required for sportswear.

An interlock fabric of a union fabric obtained by mixing a synthetic fiber and a natural fiber is suited as a material for sportswear and demand for this fabric is increasing.

In comparison with an interlock fabric using 100% synthetic fabric yarns, the interlock yarn of a cotton union yarn is highly appraised because it uses the synthetic fiber as the front fabric and the natural fiber as the under fabric in order to make the most of high abrasion resistance and attractive appearance of the synthetic fiber and the excellent sweat-absorption and feeling of the natural fiber.

However, the interlock fabric of the cotton union fabric available at present does not yet possess all the characteristic requirements for sportswear.

Originally, in addition to such requirements as abrasion-resistance, good appearance, sweat-absorption and temperature-retaining property, sportswear should be very comfortable to wear, and this is believed to be the requirement of the utmost importance. Since the cnventional interlock fabric of the cotton union fabric is produced by merely combining the synthetic fabric with the natural fiber to make use of the characteristic properties inherent to each fiber, it is not entirely satisfactory from the viewpoint of fabric structure. Especially, it is still insufficient with respect to comfort, that is, the stretchability and temperature-retaining property of the fabric.

As a result of intensive research for the completion of an interlock fabric with a lining which eliminates the abovementioned drawbacks and has every necessary function for sportswear, the inventors of the present invention have succeeded in obtaining an interlock fabric with a lining which is most suited for sportswear by making the most of the advantages of both synthetic and natural fibers and by effecting a unique and novel improvement in the knit structure.

An embodiment of the present invention will hereinafter be explained. Using an interlock circular knitting machine having 22 gauges each of a 30-inch diameter, 48 feeders and a 4-step cylinder needle selection mechanism while the cylinders have 22 gauges and the dial is provided with 11 gauges by selective use of every other needle, knitting is made from polyester filament finished yarn of 270 deniers as the front yarn and polyester-cotton blended single yarn of count No. 30 as the under yarn, and after completion of knitting, the resulting fabric is subjected to a dye finish. Thus, there is obtained an interlock fabric having a width of 150 cm for the finished fabric and a METSUKE of 460 g/m. Upon measurement of the stretch ratios of the fabric in both longitudinal and transverse directions, the stretch ratio in the longitudinal direction is found to be 165% while that in the transverse direction is found to be 175%. In comparison with the interlock fabric of a cotton union fabric available at present, it is found that the stretch ratio in the longitudinal direction of the fabric of the invention is greater while that in the transverse direction is substantially the same.

The knitting method according to the present invention will be explained by referring to the accompanying drawings illustrating an embodiment thereof.

Figure 1:
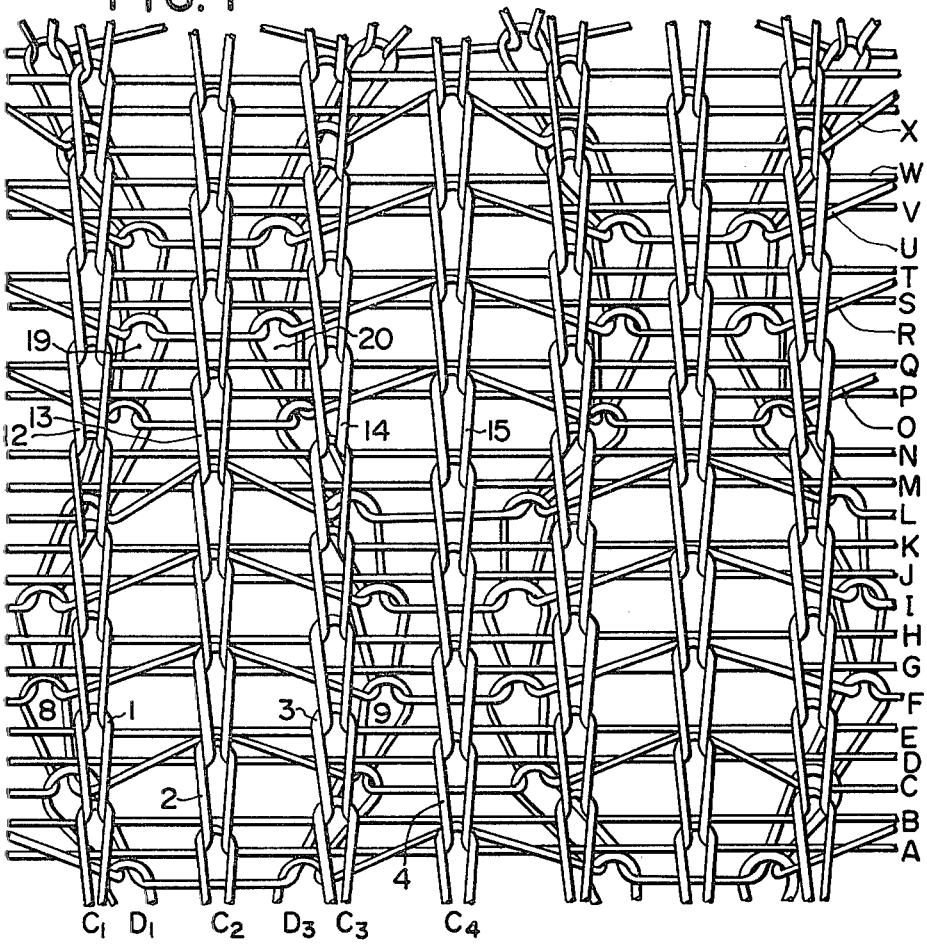
FIG. 1 is an enlarged view of the structure of the interlock fabric.
Figure 2:
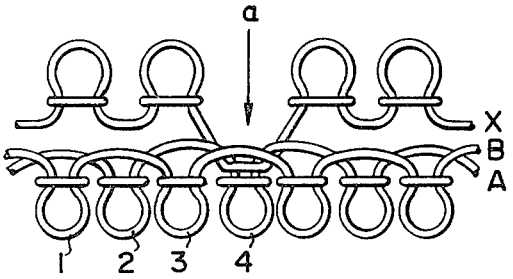
FIG. 2 is an enlarged sectional view of the principal portions.
Figure 3:
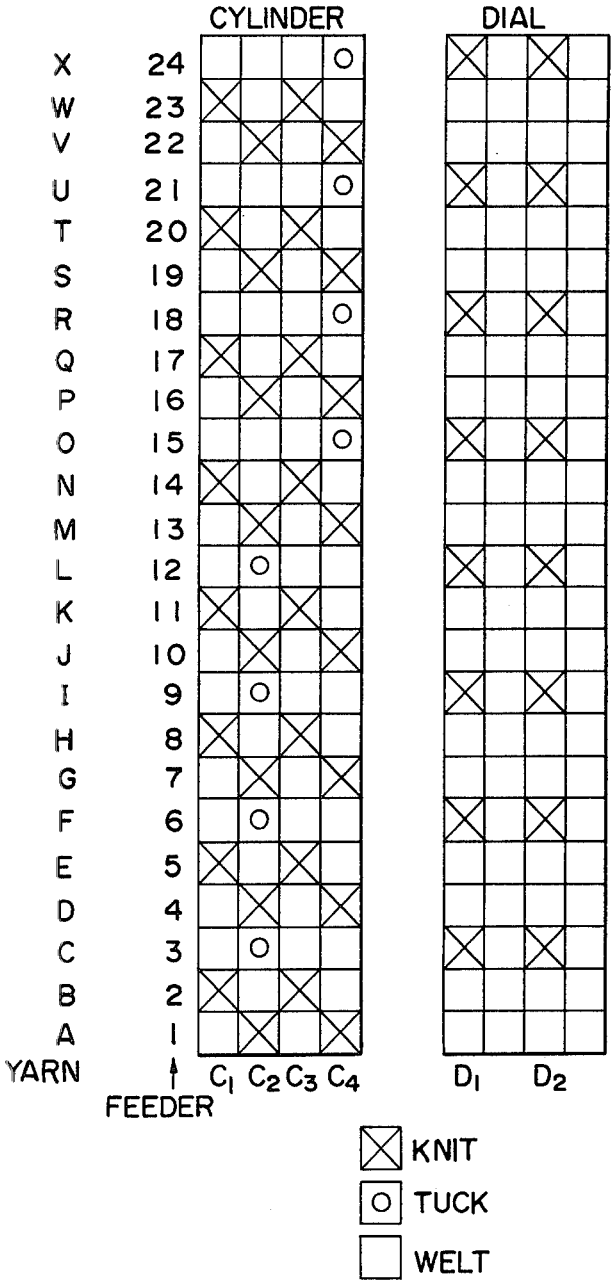
FIG. 3 is a schematic view useful for explaining the knit structure.

Referring to the drawings, knits 2, 4 are formed at the first feeder using the synthetic fiber yarn A and the knits 1, 3 are formed at the second feeder using the synthetic fiber yarn B. Purls 8, 9 are formed at the third feeder using the natural fiber yarn C and at the same time, a tuck stitch is made using a cylinder needle of a front vertical row $C_2$, thus seaming the front fabric and the back fabric.

In the same way, knits are formed by the synthetic fiber yarns D, E, G, H, J and K and purls by the natural fiber yarns F, I and L and at the same time, a tuck stitch is made by the cylinder needles of the front vertical row $C_2$, thereby repeating the seam of the front fabric and the back fabric up to the 12th feeder. Subsequently, the knits 13, 15 are formed by the use of the synthetic fiber yarn M at the 13th feeder, the knits 12, 14 by the synthetic fiber yarn N at the 14th feeder and the purls 19, 20 at the 15th feeder by the natural fiber yarn O and at the same time, a tuck stitch is made by the cylinder needles of the front vertical row $C_4$, thereby seaming the front fabric and the back fabric. In the same way, the knits are formed by the synthetic fiber yarns P, Q, S, T, V and W and the purls by the natural fiber yarns R, U and X, and at the same time, a tuck stitch is made by the cylinder needles of the back vertical row $C_4$, thereby repeating the seam of the front fabric and the back fabric up to the 24th feeder.

Repeating knitting back and forth and right and left in accordance with the above-described method provides an interlock fabric having knits of flat and attractive appearance and the purls of uneven honeycomb-like gaps a.

In the present invention, the front fabric is formed by the synthetic fiber yarns and the density of the vertical row of the knits is twice that of the purls. For these reasons, the stitch density of the front surface is compact and is possessed of high abrasion-resistance and attractive appearance. As the interlock fabric of the invention has a specific knit structure in which the front fabric is compact while the back fabric has a specific honeycomb-like structure, the fabric has a greater thickness and a greater air-retention. This prevents a loss of body temperature and permits a suitable discharge of moisture by means of the gaps a. Since the back fabric uses the natural fiber having excellent sweat-absorption and has purls which are twice as coarse as the knits, the surface area of the back yarns are greater so that the moisture due to sweat is rapidly absorbed, ensuring comfort at all times.

It is another feature of this knit structure that the dial needle gauge is made one-half the cylinder needle gauge.

In other words, since the number of the vertical row of the purls is made ½ that of the knits, the stretch ratio in the longitudinal and transverse directions of each of knit and purl is increased to bring them into substantial conformity with each other. Since the interlock fabric has large stretch ratios in both longitudinal and transverse directions that are substantially equal to each other, wearer comfort is greatly enhanced when sportswear made of the fabric is worn.

As described in the foregoing paragraph, the interlock fabric of the present invention has an excellent temperature-retaining property as well as high and uniform stretch ratios in both longitudinal and transverse directions due to the specific knit structure in addition to high abrasion-resistance and attractive appearance afforded by the front fabric and the sweat-absorption provided by the back fabric. Using the interlock fabric of the present invention as the material for sportswear affords novel sportswear having all the necessary functions.

What is claimed is:

1. An interlock fabric with a lining wherein, for the front fabric, plain stitches are formed using 100% synthetic fiber yarns, A, B, D, E, G, H, J, K, M, N, P, Q, S, T, V and W, and for the back fabric, use is made of yarns including a natural fiber having excellent sweat-absorption C, F, I, L, O, R, U and X whereby there are twice as many front vertical rows ($C_1$, $C_2$, $C_3$, $C_4$) as back vertical rows ($D_1$, $D_3$) and the back yarns C, F, I and L form purls at the back vertical rows $D_1$, $D_3$ and at the same time, are connected to the knits at the front vertical row $C_2$, while the back yarns O, R, U and X form purls at the back vertical rows $D_1$, $D_3$ and at the same time, are connected by a tuck stitch at the front vertical row $C_4$, so that the front fabric has a flat surface due to the plain stitch and the back fabric has honeycomb-like gaps a due to the tuck stitch.

2. An interlock fabric according to claim 1, wherein the yarn for the back fabric is made of blended yarns of the natural fiber with other fibers.

3. An interlock fabric having a front fabric with a back lining wherein, for the front fabric, plain stiches defining front vertical rows $C_1$, $C_2$, $C_3$, $C_4$ are formed using 100% synthetic fiber yarns A, B, D, E, G, H, J, K, M, N, P, Q, S, T, V and W, and for the back lining stitches defining back vertical rows $D_1$, $D_3$ are made of yarns C, F, I, L, O, R, U and X, there being twice as many front vertical rows as back vertical rows, the yarns forming the back vertical rows including a natural fiber having excellent sweat-absorption whereby the yarns C, F, I and L form purls at the back vertical rows $D_1$, $D_3$ and at the same time, are connected to the knits at the front vertical row $C_2$, while the yarns O, R, U and X form purls at the back vertical rows $D_1$, $D_3$ and at the same time, are connected by a tuck stitch at the front vertical row $C_4$, so that the front fabric has a flat surface due to the plain stitch and the back lining has honeycomb-like gaps of variable width a due to the tuck stitch.

4. An interlock fabric according to claim 3, wherein the yarn for the back lining is a natural fiber.

5. An interlock fabric according to claim 3, wherein the yarn for the back lining is a blended yarn of natural fiber with other fibers.

6. An interlock fiber according to one of claims 3, 4, or 5, wherein the front vertical rows are substantially parallel with each other and the back vertical rows extend in zigzag fashion to form the honeycomb-like gaps a.

* * * * *